US005645276A

United States Patent [19]

Parsons

[11] Patent Number: 5,645,276

[45] Date of Patent: Jul. 8, 1997

[54] FORMED GRIP FOR EXPANDABLE BATONS

[75] Inventor: Kevin L. Parsons, Appleton, Wis.

[73] Assignee: Armament Systems and Procedures, Inc., Appleton, Wis.

[21] Appl. No.: 410,764

[22] Filed: Mar. 27, 1995

[51] Int. Cl.[6] ..... A63B 67/00

[52] U.S. Cl. ..... 463/47.7; 16/110 R; 16/DIG. 12

[58] Field of Search ..... 273/84 R, 84 ES, 273/81 R, 75, 67 DB, 67 R; 16/110 R, 116 R, DIG. 12; 473/298, 300

[56] References Cited

U.S. PATENT DOCUMENTS 2,604,661 7/1952 Karns ..... 273/81 R 3,770,033 11/1973 Gavillet et al. ..... 273/81 R 5,110,375 5/1992 Parsons ..... 273/84 R 5,348,296 9/1994 Frederiksen ..... 273/84 R

*Primary Examiner*—William M. Pierce

*Attorney, Agent, or Firm*—Robert C. Curfiss; Mark A. Tidwell; Butler & Binion

[57] ABSTRACT

A cover for an expandable baton handle is molded onto the handle to provide an integral, unitary handle grip which is permanently bonded to the handle section of the baton. This permits secure bonding and formed contours to conform to the precise shape of the handle, eliminating collars and weak bonding areas, particularly in tapered sections such as used with wedge lock designs.

12 Claims, 1 Drawing Sheet

10
12
16
14

21
28
18
14
20

23
22

5
5

10
12
22
18
26
20

FORMED GRIP FOR EXPANDABLE BATONS

BACKGROUND OF INVENTION

1. Field of Invention

This invention is directed generally to expandable batons for use by law enforcement personnel and is specifically directed to a formed handle grip for such batons.

2. Description of the Prior Art

Expandable batons are well known intermediate force weapons used as a restraint device by law enforcement personnel. Typically, such batons include a plurality of nesting sections which may be whipped and telescoped into the expanded position and locked in place in a single motion. The locking mechanism may include a button lock system as shown in my issued U.S. Pat. No. 5,149,092, or a tapered wedge lock system as shown in my U.S. Pat. No. 5,348,297.

The largest section of the nesting baton typically defines the handle by which the baton is gripped during use. It is desirable that the handle be covered with a high-friction grip in order to permit maximum utilization of the baton while minimizing the risk of the baton slipping out of the grasp of the user. The material for the grip must be capable of withstanding rigorous, repeated use without separating from the baton handle section. In the prior art, several different grip styles and designs are available, ranging from a knurled surface applied directly to the baton casing to wrapping or enveloping the baton section with a Neoprene brand, Hypolon brand or foamed vinyl cover.

The knurled handle increases the friction over a smooth surface, but not to a degree sufficient to achieve the desired functional result. That is, the friction level of the grip is still too low for certain whipping motions, increasing the risk of the baton flying out of the hand during use. Alternatively, too much knurling may eat through clothing or wear the lining of a coat or shirt. However, the knurled handle does meet the requirements of being durable and permanently secured to the baton, thereby minimizing loss of function through wear and tear.

As more exotic materials are utilized for batons, from wound fibers to hardened steel or tungsten/magnesium alloys, the cost of machining a knurled handle becomes almost prohibitive.

More recently, the handle sections are covered with a cylindrical tube cover formed to fit snugly on the periphery of the baton. The covers are bonded to the baton by either glue or other bonding adhesives which are applied directly to the abutting surfaces or through the use of double backed tape or the like. Double backed tape is particularly useful since it allows the best available bonding agent to be applied directly to the cover while at the same time permitting use of the most effective bonding agent to be applied against the surface of the baton section.

However, even with the use of double backed tapes, after repeated uses the cover will slip relative to the baton and the front exposed edge of the cover tends to wear and roll back from repeated insertion of the baton into a typical scabbard used for stowing the baton on the person of the law enforcement personnel. This is particularly true if the baton includes an integral taper, making a tubular cover loose in specific regions of the handle.

Rigid annular collars have helped alleviate this problem, but such collars increase both the cost of material and the cost of assembly of the baton. In addition, it is possible that such collars will separate from the baton, further increasing the possibility of reducing the functional life of the device.

Because of the critical applications in which such batons are employed, it is important that the handle grip be secure and maintained at optimum function throughout its life. Therefore, there remains a need for a durable friction grip for expandable batons designed for law enforcement use.

SUMMARY OF THE INVENTION

The subject invention is specifically directed to a durable friction grip for an expandable baton for law enforcement use. The preferred embodiment of the invention includes a handle cover which is formed on and bonded directly to the outer section of the expandable baton. This eliminates loose outer ends and resultant rolling or tearing of the cover through repeated use. The resulting grip is durable, is permanently bonded to the baton and is inexpensive to manufacture, the forming and bonding steps being accomplished in a single overmolding process.

In the preferred embodiment, the tubular handle is placed in a mold cavity and the grip material is injection molded directly onto the handle. Not only does this permanently bond the material to the baton handle section, but the mold cavity defines the custom shape of the grip cover, permitting an integral, continuous, wrap around construction, greatly enhancing both the appearance and the durability of the grip. In addition, the molding process eliminates several steps of manufacture, reducing the overall costs of the product.

Overmolding in this manner also permits a broader selection of grips to be utilized without changing the manufacturing process. Various pigments may be added to the stock material to permit handles of different, selected colors. The composition of the stock material and the pressure and cure time of the molding process may be adjusted to provide handles ranging from a hard, rigid material to a soft, compressible or resilient grip. The outer surface of the grip may be controlled by the mold cavity surface.

The molded and formed grip of the subject invention greatly improves the function and appearance of the handle while at the same time reducing the costs of the finished baton.

It is, therefore, an object and feature of the subject invention to proved a formed grip for the handle portion of an expandable baton for law enforcement use.

It is an additional object and feature of the subject invention to provide a grip which is permanently bonded to the baton section.

It is another object and feature of the subject invention to provide a grip having outer ends which do not come loose or roll back as a result of repeated insertions of the baton into a standard baton scabbard on the person of the law enforcement personnel for stowing the baton.

It is yet another object and feature of the subject invention to provide a baton having a variety of color grips and texture grips using a single manufacturing process.

Other objects and features of the invention will be readily apparent from the following drawings and detailed description of the preferred embodiments.

DETAILED DESCRIPTION OF THE PREFERRED EMBODIMENT

Figures 1, 2, 3, 4, 5:
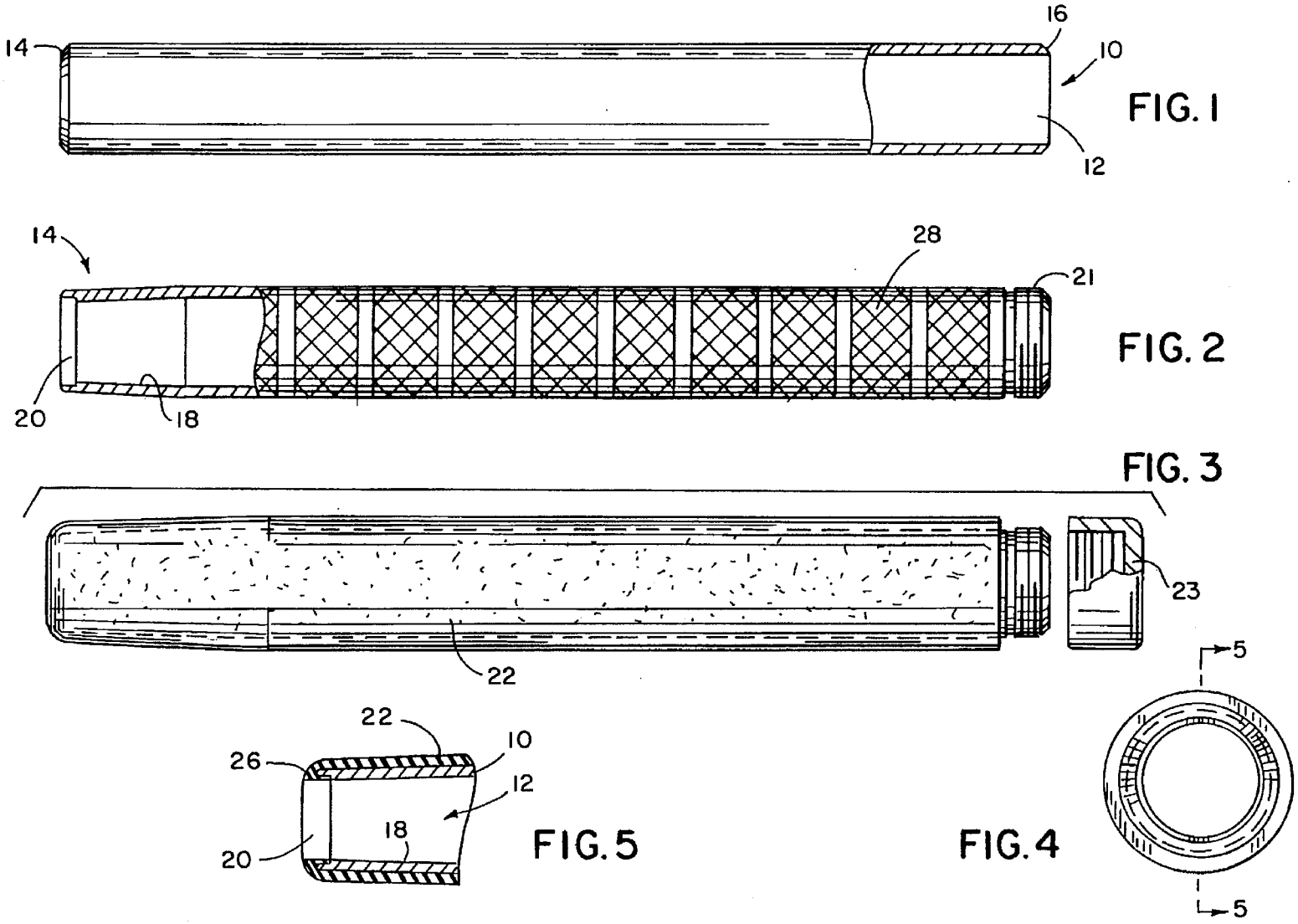
FIG. 1 is a longitudinal view of a standard tubular handle section of an expandable baton, prior to machining.
FIG. 2 is a longitudinal view of the tubular section of FIG. 1, after machining and swaging to form the finished handle.
FIG. 3 is a longitudinal view of the handle of FIG. 2 with the formed, molded grip member and handle and end cap assembly.
FIG. 4 is an end view of the handle of FIG. 3.
FIG. 5 is a partial sectional view taken along line 5—5 of FIG. 4 to show the detail of the molded grip member with a lip molded adjacent the end of the grip.

A typical tube blank for defining the handle portion of an expandable baton is shown in FIG. 1. The handle shown is of the type utilized in the friction lock baton shown and described in my U.S. Pat. No. 5,348,297, incorporated by reference herein. The tubular handle section 10 includes a hollow, cylindrical tube 12 which is adapted to receive and nest additional sections of the baton. In the preferred embodiment, the handle is 7.187 inches in length with an external diameter of 0.875 inches, and is made of 14 gauge steel tubing. The ends 14 and 16 are chamfered typically at 45 degrees. As shown in FIG. 2, one end 14 of the tube is swedged approximately 0.875 inches to form a reducing interior taper 18. This interior taper forms the handle portion of the wedge lock system as described in my aforementioned U.S. Pat. No. 5,348,297. The outermost end 20 is bored to provide an enlarged annular recess for receiving and seating the periphery of the button end of the baton, also as shown in my aforementioned U.S. Pat. No. 5,149,092. The opposite end 16 of the tube is externally threaded at 21 for receiving an end cap 23 (FIG. 3) in order to hold the assembled nested baton sections in place.

It will be noted that the machined area 20 and swedged area 18 present unique problems for a cover to be placed over the tube in order to provide a good friction grip. Specifically, tubular material will be somewhat loose at the swedged area in relationship to the remainder of the tube. Also, the exposed metal in the bore area 20 will generate and undesirable "clicking" sound when the button tip seats in the annular recess. In the past, this has been resolved by placing an annular ring or collar over the end 14, increasing both material and assembly costs.

The reduced diameter of the swedged section 18 can only be dealt with by utilizing a custom form cover instead of a standard straight cylindrical tube cover, greatly increasing the cost of the cover. In the prior art, a straight cylindrical tubular cover was generally utilized with a bonding agent between the cover and the steel tube. While generally suitable, the end of the cover adjacent outer end 14 of the tube would tend to roll up, particularly since the cover was slightly oversize due to the swedged area 18.

In the preferred embodiment, the machined and swedged handle section is placed in a mold cavity and the cover 22, see FIGS. 3, 4, 5 is injection molded around the handle. This permits the cover 22 to be tightly and permanently bonded not only to the straight section of the tube 10, but also to the swedged, tapered section 18, as well. As is shown in FIG. 5, the outer end 24 of the cover may be formed to enclose the exposed outer end 14 of the handle to serve as a cushion for the baton tip. Furthermore, as is shown in FIG. 5, the outer end 24 of the cover may continue into the annular recess 20, as shown at 26, thereby eliminating the necessity of an end cap. The molded cover 22 provides an integral cover form fitted to the contours of the handle section, covering all exposed areas where metal-to-metal contact is not desired. In addition, the integral cover eliminates any roll up tendencies previously due to loose fitting areas around the swedged portion.

The specific finish texture of the outer wall of the cover 22 is controlled by the surface of the mold cavity. Hardness of the cover is controlled by mold pressure, cure time and composition of the material. The cover color of the mold may be altered by providing pigmentation in the material composition which is injected into the mold.

In the preferred embodiment, and as shown in FIG. 2, the outer surface of tube may be knurled or otherwise roughened as at 28 to provide a better gripping or bonding surface for the molded handle 22. While the entire length of the tube 10 is knurled in the embodiment shown, good enhanced bonding may be achieved with knurling only at or near the threaded end 21 of the tube. This is because the wrapping of the handle 22 at 26 provides a good bond at the opposite end.

While certain features and embodiments of the invention have been described herein, it will be readily understood that the invention encompasses all modifications and enhancements within the scope and spirit of the following claims.

What is claimed is:

1. A handle cover in combination with an expandable baton, wherein the baton is formed in part of a tube having a first end, a middle portion, and a second end, the first end of the tube having an end surface and an annular recess defined around the inner surface adjacent the end surface, and further defined by a reduced, tapered section, wherein the middle portion and the second end are of substantially the same outer diameter, the cover comprising:

a first portion having an inner diameter and an outer diameter, wherein the inner diameter Of the first portion of the cover is substantially the same as the outer diameter of the second end and middle portion of the tube of the baton;

a second portion having an inner diameter and an outer diameter defining a cross sectional thickness, the inner and outer diameters of the second portion of the cover conforming to the reduced, tapered section of the first end of the tube of the baton, wherein the inner diameter Of the second portion of the cover is less than the inner diameter of the first portion of the handle cover and the outer diameter of the second portion of the cover is less than the outer diameter of the first portion of the handle cover;

an end portion attached to the second portion of the cover, the end portion of the cover molded to fit around the end surface of the first end of the tube of the baton; and a lip attached to the end portion of the cover, wherein the lip is molded to fit in the annular recess of the first end of the tube of the baton.

2. The handle cover of claim 1 wherein the end portion of the second portion of the cover has a cross sectional thickness that is greater than the cross sectional thickness of the second portion of the cover.

3. A handle in combination with an expandable baton, the handle comprising:

a hollow cylindrical tube having an inner surface, an outer surface, a first end, a middle portion, and a second end, the first end having an end surface and an annular recess defined around the inner surface adjacent the end surface, the first end further defined by a reduced, tapered section, wherein the middle portion and the second end are of substantially the same outer diameter; and a cover mounted on said tube, said cover comprising:

a first portion having an inner diameter and an outer diameter, wherein the inner diameter of the first portion of the cover is substantially the same as the outer diameter of the second end and middle portion of said tube;

a second portion having an inner diameter and an outer diameter which conform to the reduced, tapered section of the first end of said tube, wherein the inner diameter of the second portion of the cover is less than the inner diameter of the first portion of said cover and the outer diameter of the second portion of the cover is less than the outer diameter of the first portion of said cover;

an end portion attached to the second portion of the cover and molded to fit around at least a portion of the end surface of the first end of said tube; and a lip attached to the end portion, wherein the lip is molded to fit in at least a portion of the annular recess of the first end of said tube.

4. The handle of claim 3 wherein the end portion of the cover is thicker than the second portion of the cover.

5. The handle of claim 3, wherein the cover is formed of a single integral section.

6. The handle of claim 3, wherein the outer surface of the tube is textured.

7. The handle of claim 3, wherein the first end of the tube is completely surrounded by the formed cover.

8. The handle of claim 3, wherein the second end of the tube has an externally threaded portion, and the cover having an end wall inwardly of the threaded portion.

9. A handle in combination with an expandable baton having at least one member telescopingly mounted in the handle, wherein the telescoping member includes an enlarged outer end having a diameter which permits the enlarged outer end to be seated in the handle when the telescoping section is nested in the handle, the handle comprising:

a hollow cylindrical tube having an inner surface, an outer surface, a first end, a middle portion, and a second end, the first end having an end surface and an annular recess defined around the inner surface adjacent the end surface, and further defined by a reduced, tapered section adjacent the first end of the tube, wherein the middle portion and the second end of the tube are of substantially the same outer diameter; and a cover mounted on said tube, said cover comprising:

a first portion having an inner diameter and an outer diameter, wherein the inner diameter of the first portion of the cover is substantially the same as the outer diameter of the second end and middle portion of said tube;

a second portion having an inner diameter and an outer diameter which conform to the reduced, tapered section of the first end of said tube, wherein the inner diameter of the second portion of the cover is less than the inner diameter of the first portion of said cover and the outer diameter of the second portion of the cover is less than the outer diameter of the first portion of said cover; and an end portion attached to the second portion of the cover, the end portion of the cover molded to fit around at least a portion of the end surface of the first end of said tube.

10. The handle of claim 9 further comprising a lip attached to the end portion, wherein the lip is molded to fit in at least a portion of the annular recess of the first end of said tube, such that when the enlarged outer end of the telescoping member is seated in the handle, the lip fits at least partially around the telescoping member.

11. A handle for an expandable baton, the handle comprising:

a hollow cylindrical tube having an inner surface, an outer surface, a first end, a middle portion, and a second end, the first end of the cube having an end surface and an annular recess defined around the inner surface adjacent the end surface, the first end further defined by a reduced, tapered section; and a cover mounted on said tube, said cover comprising:

a first portion at least partially covering the middle portion and second end of said tube;

a second portion at least partially covering the reduced, tapered section of the first end of said tube; and an end portion attached to the second portion of the cover, the end portion of the cover molded to fit around at least a portion of the end surface of the first end of said tube.

12. The handle of claim 11 further comprising a lip attached to the end portion, wherein the lip is molded to fit in at least a portion of the annular recess of the first end of said tube.

* * * * *